US009394730B2

(12) United States Patent
Rampen

(10) Patent No.: US 9,394,730 B2
(45) Date of Patent: Jul. 19, 2016

(54) SAFETY LOCK

(76) Inventor: Edmond Rampen, Oakville (CA)

( * ) Notice: Subject to any disclaimer, the term of this patent is extended or adjusted under 35 U.S.C. 154(b) by 1429 days.

(21) Appl. No.: 12/398,686

(22) Filed: Mar. 5, 2009

(65) Prior Publication Data

US 2010/0225125 A1 Sep. 9, 2010

(51) Int. Cl.

| | |
|---|---|
| ***E05B 63/00*** | (2006.01) |
| ***E05C 1/04*** | (2006.01) |
| ***E05B 13/00*** | (2006.01) |
| ***E05B 63/06*** | (2006.01) |
| *E05B 17/20* | (2006.01) |

(52) U.S. Cl.

CPC . *E05C 1/04* (2013.01); *E05B 13/00* (2013.01); *E05B 63/06* (2013.01); *E05B 2017/2096* (2013.01); *Y10T 292/1028* (2015.04)

(58) Field of Classification Search

CPC . E05B 13/00; E05B 2017/2096; E05B 63/06; E05C 1/04

USPC ..... 292/150, 137, 163, 141, DIG. 37

See application file for complete search history.

(56) References Cited

U.S. PATENT DOCUMENTS

| | | | | |
|---|---|---|---|---|
| 2,747,241 | A * | 5/1956 | Marousky | 49/149 |
| 2,845,789 | A | 8/1958 | Kistner | |
| 3,179,454 | A | 4/1965 | Mummenday | |
| 3,315,998 | A | 4/1967 | Dallaire | |
| 3,335,453 | A * | 8/1967 | Lovelace | 16/82 |
| 3,397,000 | A * | 8/1968 | Nakanishi | 292/61 |
| 3,779,588 | A | 12/1973 | Raymon | |
| 4,066,284 | A | 1/1978 | Ikemura | |
| 4,138,150 | A * | 2/1979 | Bills | 292/60 |
| 4,635,327 | A | 1/1987 | Netznik | |
| 5,275,029 | A | 1/1994 | Myers | |
| 6,102,452 | A | 8/2000 | Liau | |
| 6,299,223 | B1 * | 10/2001 | Ji et al. | 292/175 |
| 6,655,720 | B2 * | 12/2003 | Rampen | 292/61 |

* cited by examiner

*Primary Examiner* — Kristina Fulton
*Assistant Examiner* — Thomas Neubauer
(74) *Attorney, Agent, or Firm* — Fishman Stewart PLLC

(57) ABSTRACT

A safety lock is disclosed and comprises a body, a bolt and a handle. The body is securable to one member. The bolt is mounted to the body for reciprocation between projecting and retracted positions. In the projecting position, a bolt end portion protrudes beyond the body and is engageable in another member, to prevent relative movement of the members. In the retracted position, the end portion is incapable of engagement in the other member, to permit said relative movement. The handle is releasably engageable to the bolt. The handle, body and bolt are adapted such that when the handle is engaged to the bolt, the handle permits manual reciprocation of the bolt, and are further adapted such that when the handle is disengaged from the bolt and the bolt end portion is inaccessible for manual manipulation, the bolt is inaccessible for said manual reciprocation.

14 Claims, 9 Drawing Sheets

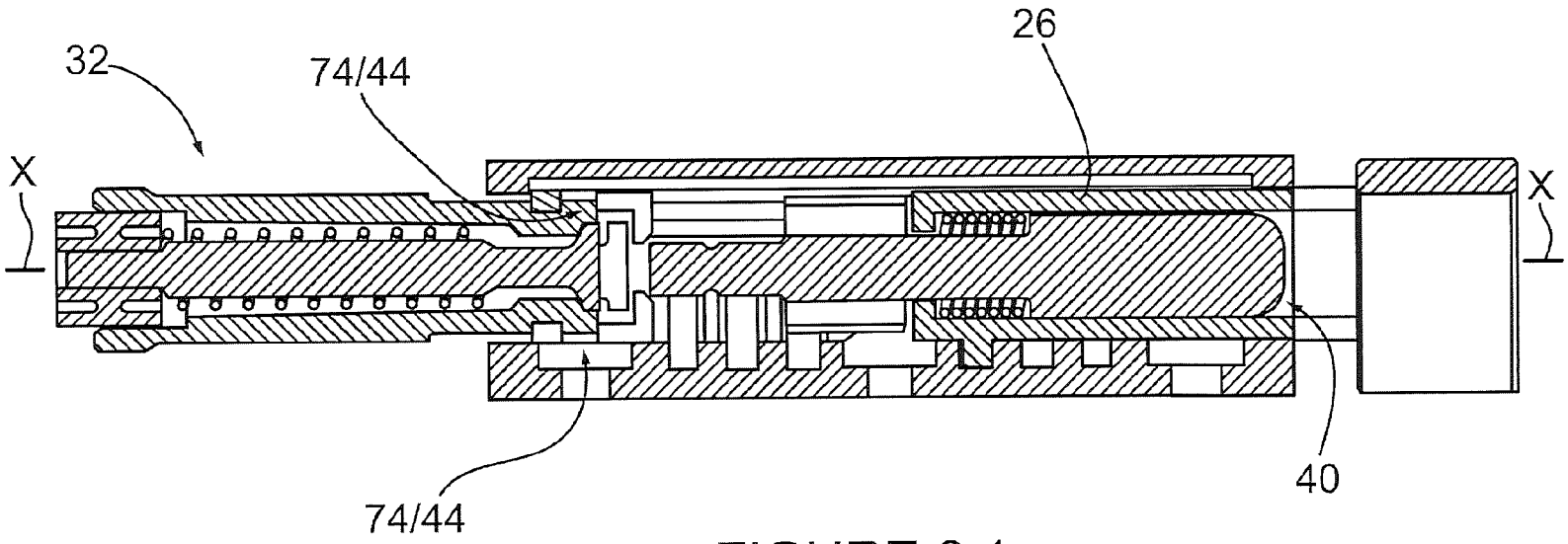
FIGURE 6.1

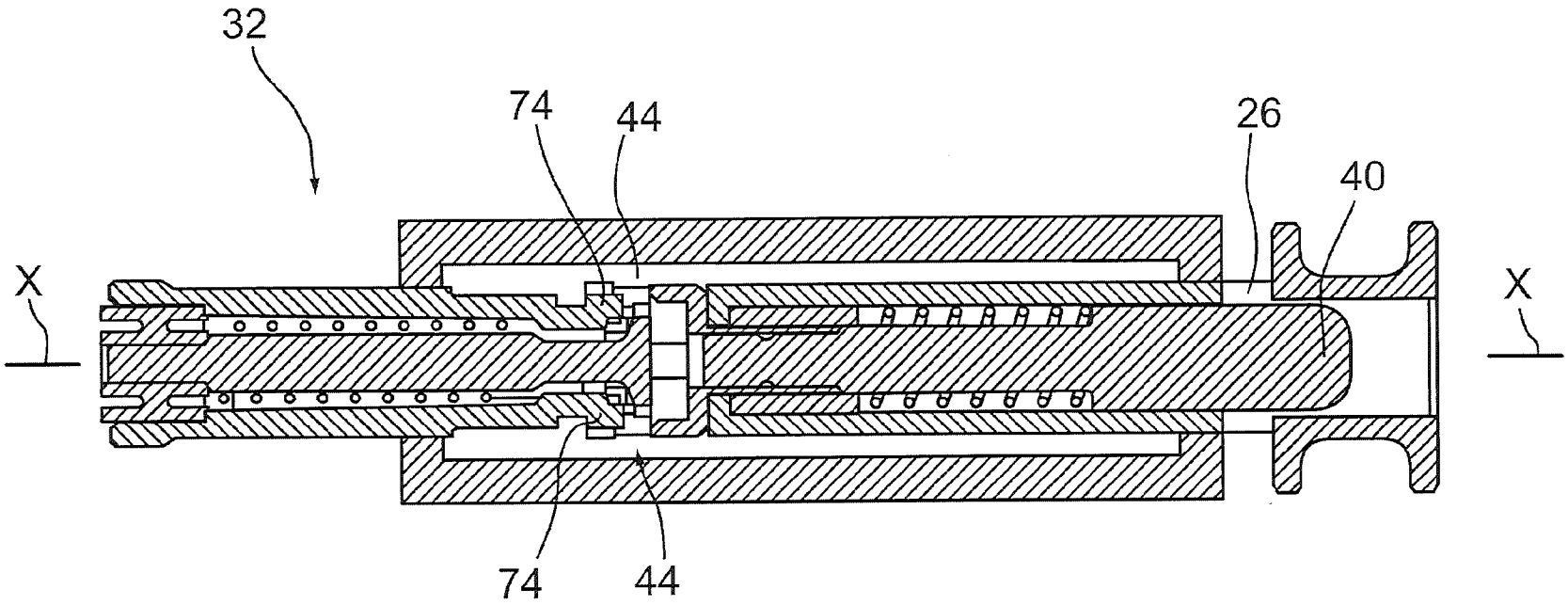
FIGURE 6.2

SAFETY LOCK

FIELD OF INVENTION

This invention relates to locks for preventing one member from moving relative to another member. One of the members may, for example, be a patio door, a window or a cupboard door, with the other member being an associated frame member.

BACKGROUND OF INVENTION

Sliding bolt locks are known to be capable of providing a relatively inexpensive and reliable solution for securing a closure such as a window or door. An advantageous sliding bolt lock is described in U.S. Pat. No. 6,655,720 (Rampen), incorporated herein by reference.

SUMMARY OF INVENTION

Forming one aspect of the invention is a safety lock. This lock comprises a body, a latch and a handle. The latch is mounted to the body for movement between an engaged position and a disengaged position. The handle is releasably engageable to the latch. The handle, body and latch are adapted such that, when the handle is engaged to the latch, the handle permits manual movement of the latch. The handle, body and latch are further adapted such that, when the handle is disengaged from the latch, the latch is inaccessible for said manual movement.

According to another aspect of the invention, the latch can be a bolt; the disengaged position can be a retracted position; the engaged position can be a projecting position whereat an end portion of the bolt protrudes beyond the body; when the handle is engaged to the bolt, the handle can permit manual reciprocation of the bolt; and, when the end portion of the bolt is inaccessible for manual manipulation, the bolt can be inaccessible for said manual reciprocation.

According to another aspect of the invention, the handle, when engaged to the bolt, can extend from the bolt to terminate in a pull, and the bolt can be manually reciprocable by the pull.

According to another aspect of the invention, the pull can be annular and have a plunger mounted therewithin for movement along an axis, and the plunger can be thumb-actuable to release the handle from the bolt and to engage the handle to the bolt.

According to another aspect of the invention, a bolt spring can act to resiliently bias the bolt for movement to the projecting position.

According to other aspects of the invention, the bolt can be rotatable within the body and the bolt and body can be shaped such that, when the bolt and body are in alignment, the bolt spring, in the absence of external force, moves the bolt to the projecting position. Further, when the bolt is rotated relative to the body out of said alignment, the body can restrain the bolt against movement to the projecting position.

According to another aspect of the invention, the pull can terminate in a rim which projects away from the axis.

According to another aspect of the invention, a plunger spring can surround the plunger within the pull and act to resiliently bias the plunger for movement beyond the rim.

According to another aspect of the invention, the plunger can be thumb-actuable in the manner by which the plunger of a syringe is thumb-drivable to eject the syringe contents.

According to other aspects of the invention, the handle can releasably engage the bolt in a plug and socket connection. In such connection, the plug can be defined by the handle and the socket can be defined by the bolt. The socket can have one or more recesses disposed on its periphery. The plug can have a tab for each of said one or more recesses and each tab can releasably engage the recess for which it is provided to provide for said releasable engagement of the handle and the bolt.

According to another aspect of the invention, each tab can be adapted to flex inwardly towards the axis for the release of the handle from the bolt.

According to another aspect of the invention, the plunger, upon thumb actuation, can move from a restraining position, wherein the plunger is disposed inwardly from each tab to restrain same against inward flexure, to a release position, wherein each tab is free for said inward movement.

Forming another aspect of the invention is another safety lock. This safety lock comprises a body, a bolt and a handle. The bolt is mounted to the body for reciprocation between a retracted position and a projecting position. In the projecting position of the bolt, an end portion of the bolt protrudes beyond the body. The handle is releasably engageable to the bolt.

The handle, body and bolt are adapted such that, when the handle is engaged to the bolt, the handle extends to and terminates in a pull by which the bolt is manually reciprocable. The handle, body and bolt are further adapted such that, when the handle is disengaged from the bolt and the end portion of the bolt is inaccessible for manual manipulation, the bolt is inaccessible for said manual reciprocation. The pull is annular and has a plunger mounted therewithin for movement along an axis. The plunger is thumb-actuable to release the handle from the bolt and to engage the handle to the bolt.

Forming yet another aspect of the invention is a further safety lock. This lock comprises a body, a bolt and a handle. The bolt is mounted to the body for reciprocation between a retracted position and a projecting position. In the projecting position of the bolt, an end portion of the bolt protrudes beyond the body. The handle is releasably engageable to the bolt. The handle, body and bolt are adapted such that, when the handle is engaged to the bolt, the handle permits manual reciprocation of the bolt. The handle, body and bolt are further adapted such that, when the handle is disengaged from the bolt and the end portion of the bolt is inaccessible for manual manipulation, the bolt is inaccessible for said manual reciprocation. The handle releasably engages the bolt in a plug and socket connection, wherein the plug is defined by the handle and the socket is defined by the bolt. The socket has one or more recesses disposed on its periphery. The plug has a tab for each of said one or more recesses and each tab releasably engages the recess for which it is provided to provide for said releasable engagement of the handle and the bolt.

According to yet other aspects of the invention, in this further safety lock, each tab can be adapted to flex inwardly towards the axis for the release of the handle from the bolt and the plunger, upon thumb actuation, moves from a restraining position, wherein the plunger is disposed inwardly from each tab to restrain same against inward flexure, to a release position, wherein each tab is free for said inward movement. In the restraining position, an end of the plunger is disposed inwardly from and abutting each tab, to restrain said each tab against said inward flexure. In the release position, a reduced girth portion of the plunger, set back from said end, is disposed inwardly from each tab, so that said each tab is free for said inward movement.

According to other aspects of the invention, the body can be an assembly of parts and can be disassembled and, when the lock is operatively mounted on an element to be secured by the lock to another element, and the element to be secured and the other element are positioned for said securement, the other element can interfere with said disassembly.

According to yet other aspects of the invention, the body can comprise a base portion and a cover portion, the base portion and the cover portion having longitudinally extending recesses and pairs of inter-engaging longitudinally-extending keyways, respectively on opposite sides, to enable the cover portion to be slidably attached to and detached from the base portion. As well, when the base portion is operatively mounted on an element to be secured by the lock to another element, and the element to be secured and the other element are positioned for said securement, the cover portion cannot be slidably detached from the base portion as a result of interference with the other element.

According to yet further aspects of the invention, one of the keyways in the cover portion can have enlarged end portions which each receive a peg at the corresponding end of the keyway in the base portion so that the cover portion, if mounted with the pegs disposed on the end of the body through which the end portion of the bolt protrudes, is more readily removed by sliding the cover portion in the direction in which bolt protrudes.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinbelow.

BRIEF DESCRIPTION OF THE DRAWINGS

FIG. 6.1 is a sectional view of the structure of FIG. 4, showing the plunger in its restraining position;

FIG. 6.2 is a sectional view similar to FIG. 6.1, with the plunger disposed in the release position and the tabs flexed inwardly;

DETAILED DESCRIPTION

Figure 2:
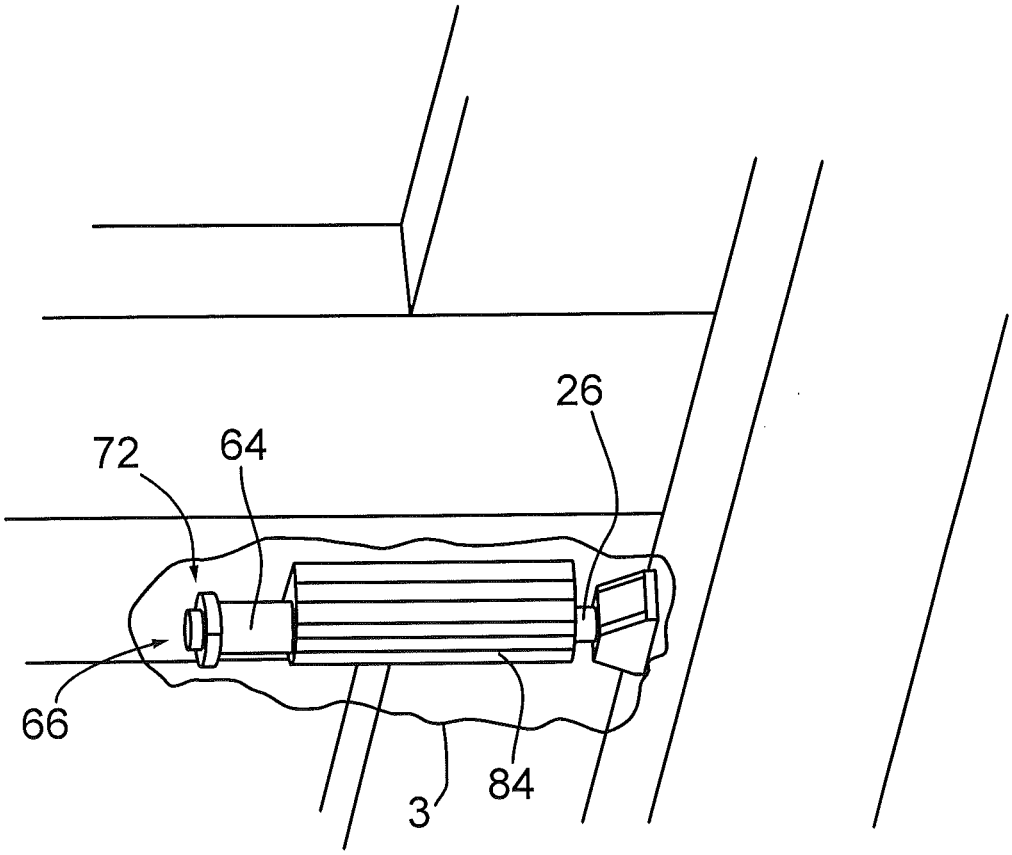
FIG. 2 is an enlarged partial top, left perspective view of the structure of FIG. 1.
Figure 3:
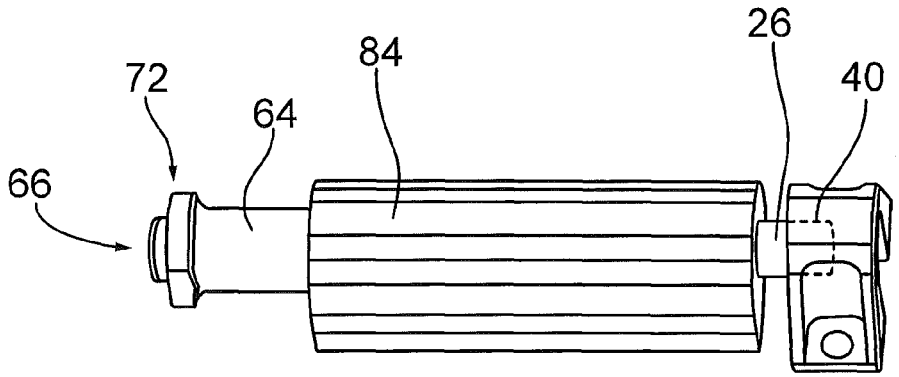
FIG. 3 is an enlarged bottom front, bottom perspective view of encircled structure 3 of FIG. 2.
Figure 4:
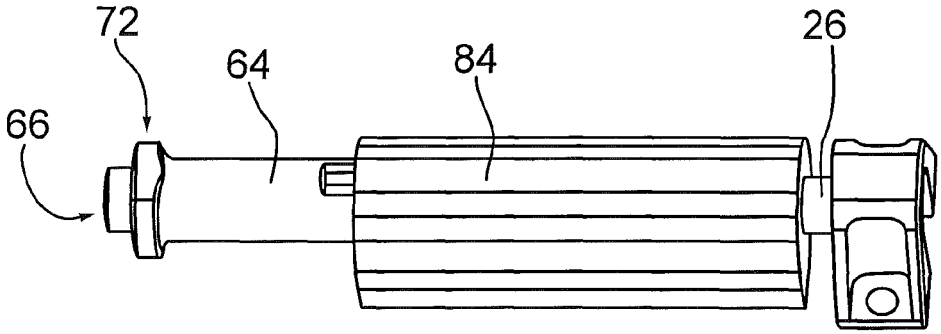
FIG. 4 is a view of the structure of FIG. 4, with the bolt in its retracted position.
Figure 10:
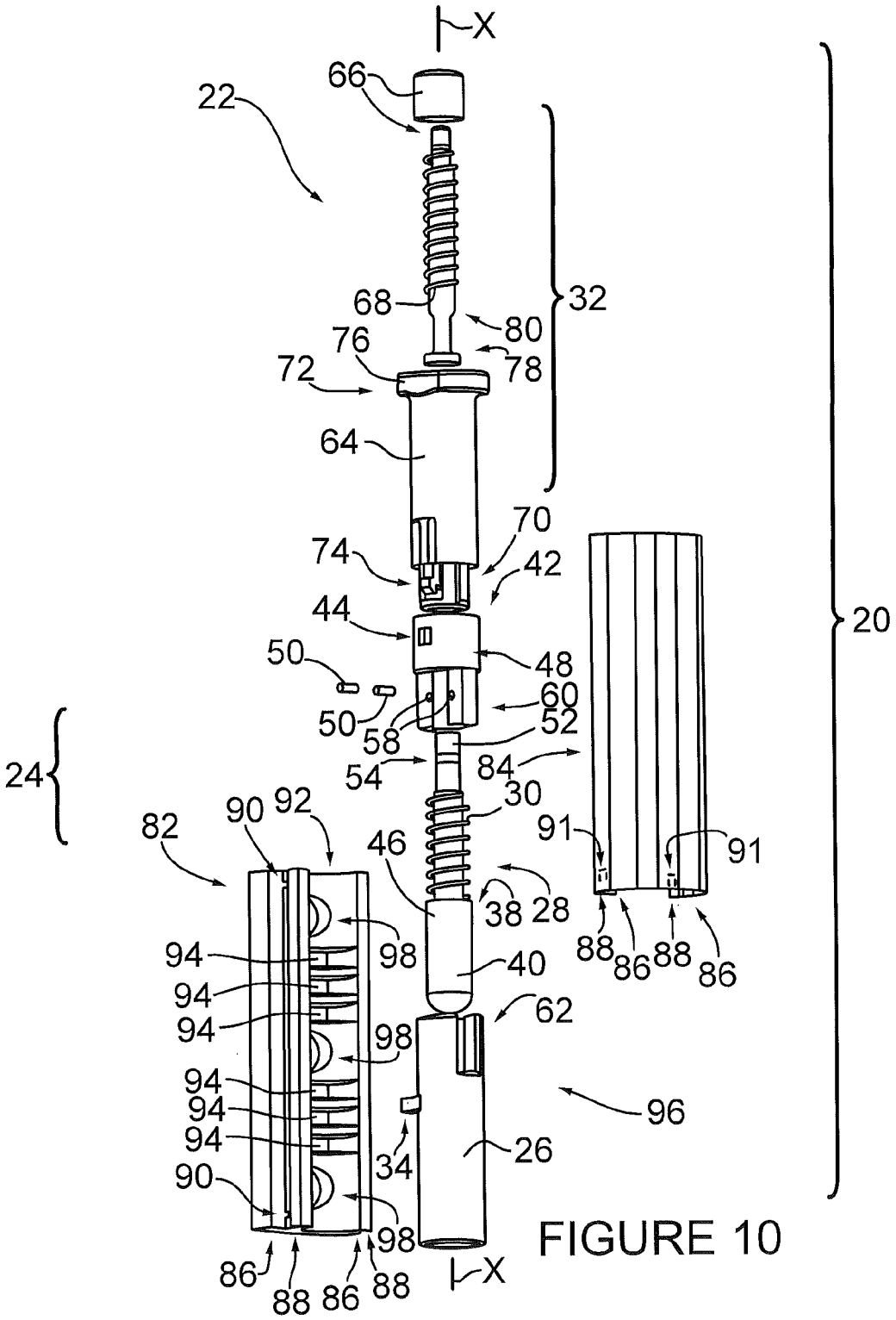
FIG. 10 is an exploded perspective view of the lock of FIG. 1.

With reference to FIG. 10, the lock 20 of the exemplary embodiment has a plunger unit 22 and a housing 24. Both the plunger unit 22 and the housing 24 are shown in exploded view in FIG. 10, but persons of ordinary skill in the art will understand, with reference to, for example, FIG. 2, that in the lock 20 as assembled, the assembled plunger unit 22 is mounted in the assembled housing 24.

The plunger unit 22 has a sleeve 26, a latch in the form of a bolt 28, a bolt spring 30 and a handle 32.

Figure 5:
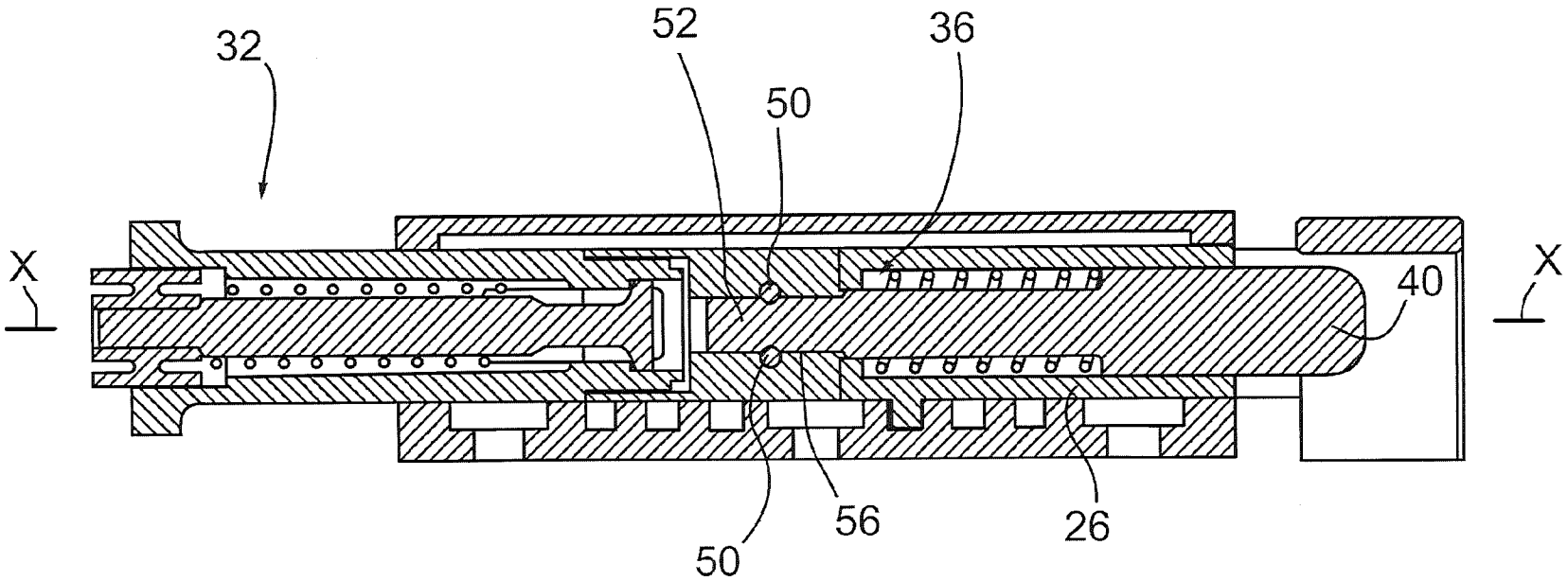
FIG. 5 is a sectional view of the structure of FIG. 3.
Figure 7:
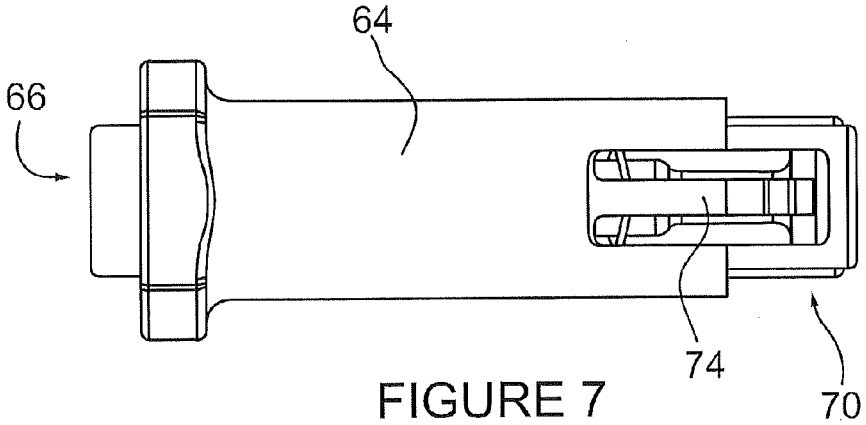
FIG. 7 is an enlarged view of the handle of the structure of FIG. 1, in isolation, with the plunger in its restraining position.

The sleeve 26 is annular, has a radially extending flange 34 and, as best seen in FIG. 5, has an inner annular shoulder 36.

Returning to FIG. 10, the bolt 28 has an annular shoulder 38 and is slidably and rotatably mounted in the sleeve for movement between a projecting position, shown in FIG. 5, in which an end portion 40 of the bolt 28 projects from one end of the sleeve 26 and a retracted position, shown in FIG. 6.1, in which said end portion 40 is disposed within the sleeve 26.

The bolt 28 further defines a socket 42, opposite to the free end portion 40 of the bolt 28. The socket 42 has a pair of opposed recesses 44 disposed on its periphery (only one recess 44 being visible in FIG. 10).

The bolt 28 is formed of a shaft 46, a fitting 48 and a pair of pins 50. The shaft 46, which defines the free end portion 40 and the annular shoulder 38, is a machined steel element and terminates in a cylindrical end 52 with a peripheral groove 54. The fitting 48, which defines the socket 42, is a molded plastic component and has a bore 56 in receipt of the cylindrical end 52, as best seen in FIG. 5.

A pair of clearance holes 58, visible in FIG. 10, flank the bore 56 and intersect opposite sides of the groove 54. The pins 50 are press fit within the clearance holes 58, to engage the groove 54 and lock the fitting 48 to the shaft 46.

The socket-forming end fitting 48 of the bolt 28 and the sleeve 26 have shaped adjacent ends 60,62, such that when the bolt 28 and sleeve 26 are in alignment, the bolt 28 is movable to the projecting position; and when the bolt 28 is rotated relative to the sleeve 26 out of said alignment, the sleeve 26 restrains the bolt 28 against movement to the projecting position.

The bolt spring 30 surrounds the bolt 28 within the sleeve 26 and acts between the annular shoulder 38 on the bolt 28 and the annular shoulder 36 on the sleeve 26 to bias the bolt 28 for movement to its projecting position.

The handle 32 includes a shell 64, a plunger 66 and a plunger spring 68. The shell 64 defines a plug 70 and extends from the plug 70 to terminate in a pull 72. The plug 70 is sized for receipt in the socket 42 and has a tab 74 for each recess 44. When the plug 70 is operatively fitted into the socket 42, each tab 74 engages the recess 44 for which it is provided, as shown in FIG. 6.1. Each tab 74 is also adapted to flex inwardly towards an axis X-X of the shell 70, as shown in FIG. 6.2, wherein the handle 32 is shown as it appears during release/engagement to/from the bolt 28. With reference to FIG. 10, the pull 72 is annular, centered about the axis X-X and terminates in a rim 76 which projects away from the axis X-X.

Figure 8:
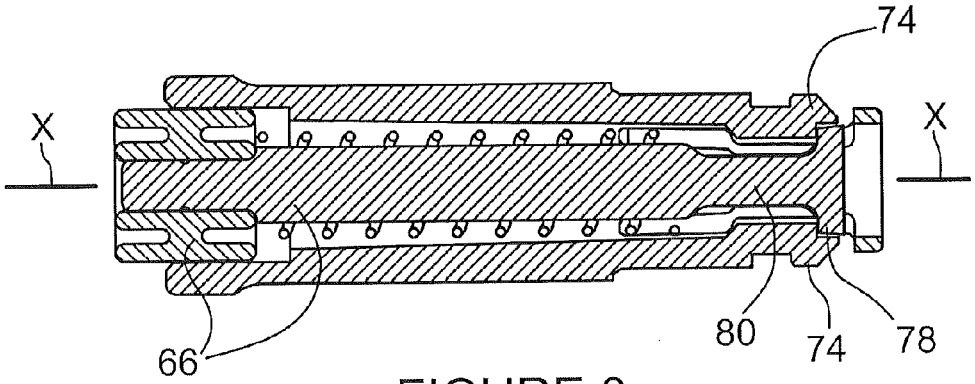
FIG. 8 is a sectional view of the structure of FIG. 7.
Figure 9:
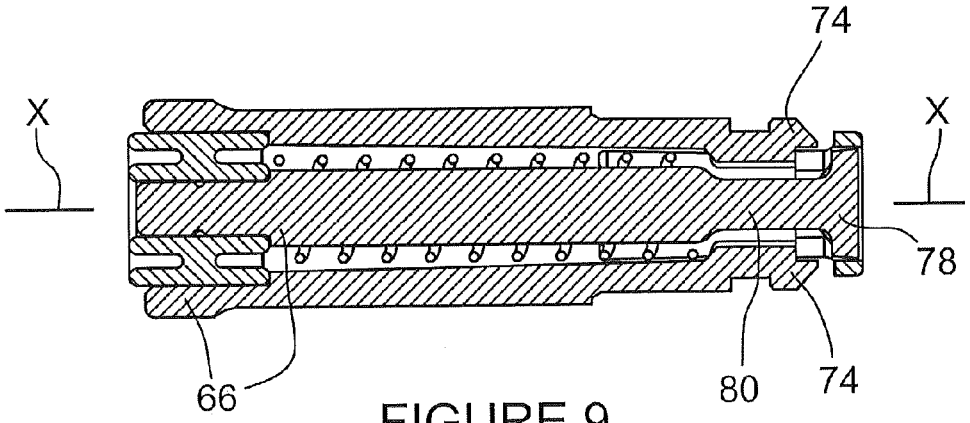
FIG. 9 is a sectional view of the structure of FIG. 7, with the plunger in its release position.

The plunger 66 is mounted for movement along the axis X-X between a restraining position, shown in FIG. 8, wherein an end 78 of the plunger 66 is disposed inwardly from each tab 74 to restrain same against the inward flexure shown in FIG. 6.2 [i.e. to provide for rigid engagement of the handle 32 and bolt 28 when operatively positioned] and a release position, shown in FIG. 9, wherein a reduced girth portion 80 of the plunger 66, set back from said end 78, is disposed inwardly from each tab 74, so that said each tab 74 is free for said inward flexing movement.

The plunger spring 68 surrounds the plunger 66 within the pull 72 and acts to resiliently bias the plunger 66 for movement beyond the rim 76.

The housing 24 has a base portion 82 and a cover portion 84. The base portion 82 and the cover portion 84 have longitudinally extending recesses 86, and pairs of inter-engaging longitudinally-extending keyways 88, respectively on opposite sides, to enable the cover portion 84 to be attached to and detached from the base portion 82.

One of the keyways in the cover portion 84 has enlarged end portions 90 which each receive a peg 91 (shown in phantom outline in FIG. 10) at the corresponding end of the keyway in the base portion 82 so that the cover portion 84 becomes correctly positioned relative to the base portion 82 in assembly.

The base portion 82 has a recess 92 for receiving the sleeve 26, the fitting 48 and the shell 64, and a series of slots 94 opening onto the recess 92. Plunger unit 22 is mounted within the housing 24 by positioning its flange 34 into one of the slots 94 before the cover portion 84 is secured to the base portion 82. So assembled, the base portion 82, cover portion 84, sleeve 26 and bolt spring 30 together define a body 96. The slot 94 selected to receive the flange 34 determines the amount by which the free end portion 40 of the bolt 28 projects from the body 96 when the bolt 28 is disposed in the projecting position.

The base portion 82 further has a series of apertures 98 to enable lock 20 to be secured, by screws or the like, to a closure to be secured for use.

Figure 1:
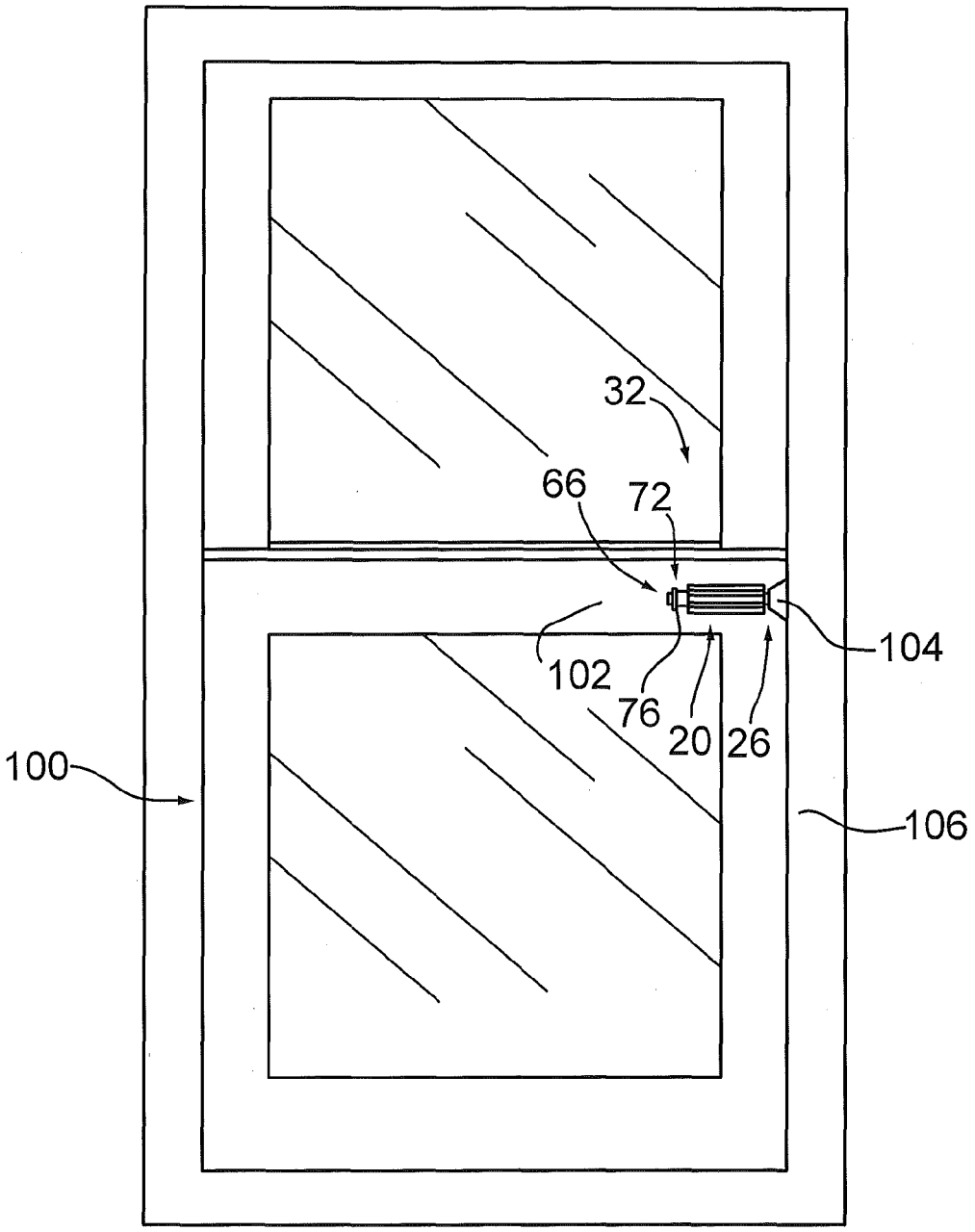
FIG. 1 is a front elevational view of a lock according to an exemplary embodiment of the invention in use on a vertical sliding sash window, with the bolt in its projecting position and engaged in a keeper mounted on the right side jamb.

FIG. 1 shows the lock 20 secured to a lower sash 100 of a window which opens from up to down. The lock 20 is secured to the window by screws (not shown) passing through the apertures 98 into the upper rail 102. As shown, the bolt (not visible) is in the projecting position and the free end portion (not visible) of the bolt extends into an aperture (not shown) in the keeper 104 secured to the right side jamb 106. The projecting position can be viewed as an engaged position in that, when operatively installed on a properly positioned sash/frame assembly, the bolt engages with a corresponding structure on the frame.

Thus, the lower sash 100 cannot be opened by sliding upward movement. In order to lock the window in this closed position:

- the pull 72 is gripped in the manner of a syringe, i.e. typically with a thumb on the plunger 66 and the forefinger and middle finger beneath the rim 76;
- the plunger 66 is depressed; and
- the pull 72 is withdrawn, to unseat the plug of the handle from the socket The thus-removed handle 32 may then be safely stored, until such time as it is desired to render the window operable again.

Since the end portion 40 of the bolt is inaccessible, being shielded by the sleeve 26 and the keeper 104, the bolt (not shown in FIG. 1) is inaccessible for manual manipulation. This renders the locked window safe for children and the like.

In order to return the immobilized window to operability;

- the pull is again gripped in the manner of a syringe;
- the plunger is depressed
- the plug of the handle is fitted into the socket; and
- the plunger is released To unlatch the window for movement from the position shown in FIG. 1, one simply draws the handle 32 by the pull from right to left (not shown), to unseat the free end portion of the bolt from the aperture in the keeper 104.

To maintain the bolt in the retracted position, so that the sash 100 may be moved in the frame without the need to maintain tension on the handle 32, the handle 32 may be turned to rotate the bolt out of alignment, so that the bolt is maintained in the retracted position by the inter-engagement of surfaces 60,62 as previously discussed. The retracted position can also be viewed as a disengaged position, since the bolt, so positioned, cannot engage with the mating structures on the frame.

The illustrated cover portion 84 is advantageously mounted such that the pegs 91 are disposed on the end of the housing 24 through which the end portion 40 of the bolt protrudes. If so mounted, the cover portion 84 is most readily removed by sliding the cover portion in the direction in which the bolt protrudes [because the cover portion has pegs 91 only at that end]. This provides additional security in that, in situations wherein the lock is engaged, the cover is restrained against movement in that direction as a result of interference with the elements being secured, i.e. the window frame.

Numerous variations in application and structure are possible.

Figure 11:
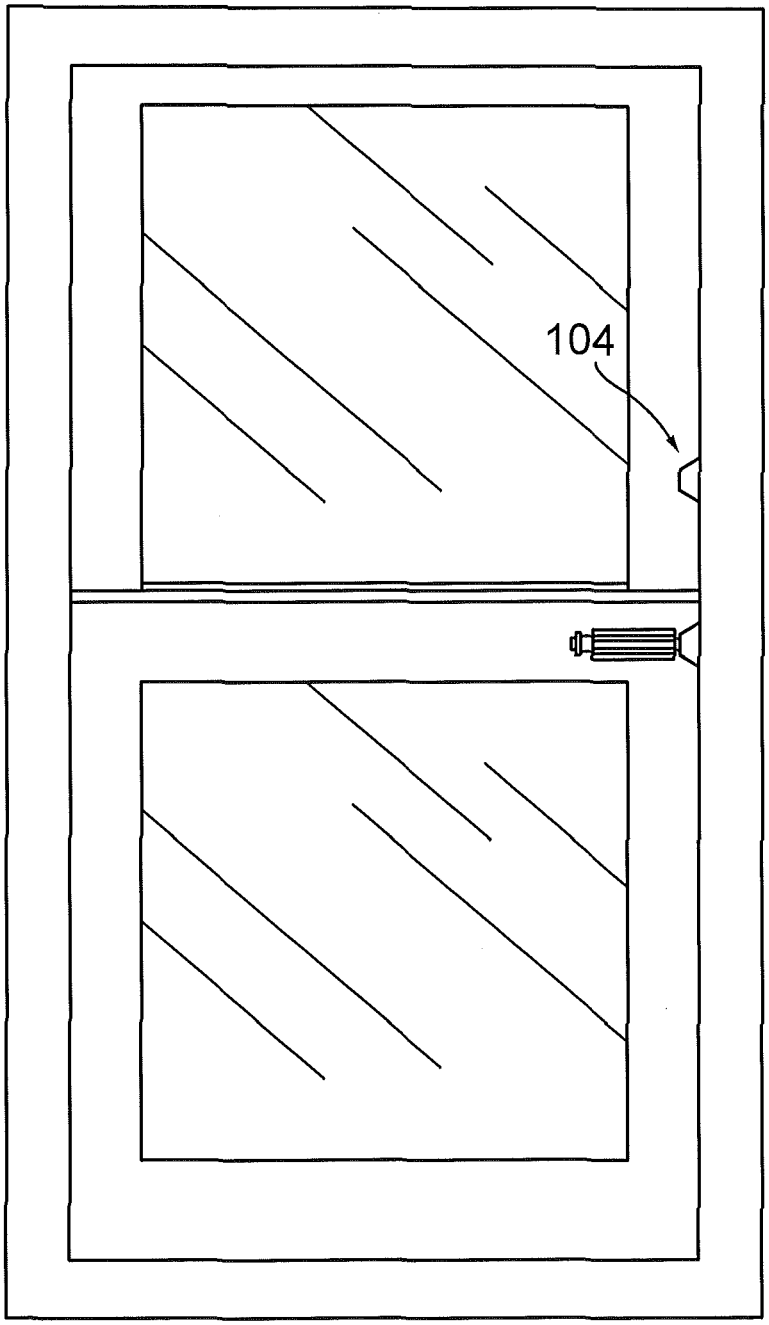
FIG. 11 is a view, similar to FIG. 1, but showing a second keeper mounted on the right side jamb.

For example, a second keeper 104 is shown in FIG. 11. By engaging the lock in the aperture of this second keeper, and removing the handle, the window can be locked in a partially-open position. This provides for ventilation. At the same time, the window opening is substantially occluded by the lower sash, so as to negate any real risk to children. As well, the absence of a handle renders the configuration relatively burglar proof.

Further, the base portion 82 could have a transverse flange with an aperture through which the handle protrudes. This would add to the difficulty of removing the cover portion 84 from the base portion 82 otherwise than by sliding the cover portion in the direction in which bolt protrudes, and provide even more security. Other forms of locating structures could also be utilized.

As well, the handle may be removed when the bolt is in its retracted position. It will be evident that, in this configuration, with the handle removed, the free end of the bolt will be disposed within the sleeve and inaccessible for manual manipulation, thereby rendering the bolt inaccessible for manual reciprocation. This makes it practically impossible for the window to be locked, which may be desirable in some situations.

Whereas the handle has been reference herein as being removable by thumb actuation, in the manner of a syringe, it should be emphasized that this functionality is only described by way of example. A person having no thumb, for example, could readily operate the device illustrated with the fingers of two hands. As well, other configurations of the invention could be provided with, for example, trigger actuators, in which case the handle release would be more preferably actuated by the forefinger.

Of course, it will be also understood by persons of ordinary skill in the art that, even with removal of the handle, it may, in some applications, remain possible for the bolt to be moved, with special tools or the like. The present invention should be understood as encompassing all locks wherein, if operatively installed, an average person, using only his or her hands, is incapable of manipulating the bolt from the retracted position to the extended position otherwise than with the handle. The present invention should also be understood as encompassing all locks wherein, if operatively installed, with the bolt engaged into a keeper or other bolt receiver, an average person, using only his or her hands, is incapable of manipulating the bolt from the extended position to the retracted position, otherwise than with the handle.

Further, the various components of the lock should be understood as amenable to other shapes and configurations, and the lock may be deployed on other structures, such as patio doors, hinged doors and the like, with or without keepers. Certain of these variations are described in U.S. Pat. No. 6,655,720, previously mentioned.

As well, greater or lesser numbers of tabs and recesses may be provided, and alternative methods of releasably locking the handle to the body may be employed.

Moreover, whereas it is indicated that a tab is provided for each recess, it will be understood that recesses could be provided in greater numbers than tabs; in this case, the excess tabs would simply be non-functional, and this would not impact whatsoever on the invention.

As well, the invention can be used with locks of other than the sliding bolt structure.

Accordingly, the invention should be understood as limited only by the appended claims, purposely construed.

The invention claimed is:

1. A safety lock comprising:

a body;

a bolt mounted to the body for movement between a disengaged position and an engaged position;

a handle including a shell that has a longitudinal axis, and the handle further includes a plunger that is moveable within the shell along the longitudinal axis, the shell being releasably engageable to a first end of the bolt; and a pair of springs surrounding a respective one of the plunger and the bolt;

wherein the handle, body and bolt are adapted such that when the shell is engaged to the first end of the bolt, the handle permits manual movement of the bolt and when the shell is disengaged from the bolt, the first end of the bolt is retained within the body such that the bolt is inaccessible for said manual movement;

wherein the shell is disengaged from the bolt upon movement of the plunger towards the bolt; and wherein the bolt and the plunger are a pair of separate components.

2. A lock according to claim 1, wherein: the disengaged position is a retracted position; the engaged position is a projecting position whereat a second end of the bolt protrudes beyond the body; when the shell is engaged to the bolt, the handle permits manual reciprocation of the bolt; and, when the first end of the bolt is inaccessible for manual manipulation, the bolt is inaccessible for said manual reciprocation.

3. A lock according to claim 2, wherein:

the shell, when engaged to the bolt, extends from the bolt to terminate in a pull, and the bolt is manually reciprocable by the pull.

4. A lock according to claim 3, further comprising a bolt spring acting to resiliently bias the bolt for movement to the projecting position.

5. A lock according to claim 4, wherein the bolt is rotatable within the body and the bolt and body are shaped such that when the bolt and body are in alignment, the bolt spring, in the absence of external force, moves the bolt to the projecting position; and when the bolt is rotated relative to the body out of said alignment, the body restrains the bolt against movement to the projecting position.

6. A lock according to claim 5, wherein the pull terminates in a rim which projects away from the longitudinal axis of the shell.

7. A lock according to claim 1, wherein:

the handle releasably engages the bolt in a plug and socket connection, the plug being defined by the handle and the socket being defined by the bolt;

wherein the socket has one or more recesses disposed on its periphery;

wherein the shell has a tab for each of said one or more recesses; and wherein each tab releasably engages one of the recesses to provide for said releasable engagement of the handle and the bolt.

8. A lock according to claim 7, wherein each tab is adapted to flex inwardly towards the longitudinal axis of the shell for the release of the handle from the bolt.

9. A lock according to claim 7, wherein the plunger is moveable from a restraining position, wherein the plunger is disposed inwardly from each tab to restrain same against inward flexure, to a release position, wherein each tab is free for said inward movement.

10. A safety lock comprising:

a body;

a bolt mounted to the body for reciprocation between a retracted position and a projecting position whereat a second end of the bolt protrudes beyond the body;

a handle including a shell having a longitudinal axis, and the handle further includes a plunger that is moveable within the shell along the longitudinal axis, the shell being releasably engageable to a first end of the bolt; and a pair of springs surrounding a respective one of the plunger and the bolt;

wherein the handle, body and bolt are adapted such that: when the shell is engaged to the first end of the bolt, the shell extends from the bolt to terminate in a pull by which the bolt is manually moveable; and when the shell is disengaged from the bolt said first end of the bolt is retained within the body and inaccessible for manual manipulation;

wherein the pull of the shell is annular and has the plunger mounted therewithin for movement along the longitudinal axis the shell, the plunger being actuable to release the shell from the bolt and to engage the shell to the bolt; and wherein the bolt and the plunger are a pair of separate components.

11. A safety lock comprising:

a body;

a bolt mounted to the body for reciprocation between a retracted position and a projecting position whereat a second end of the bolt protrudes beyond the body;

a handle including a shell that has a longitudinal axis, and the handle further includes a plunger that is moveable within the shell along the longitudinal axis, the shell being releasably engageable to a first end of the bolt; and a pair of springs surrounding a respective one of the plunger and the bolt;

wherein the handle, body and bolt are adapted such that when the shell is engaged to the first end of the bolt, the handle permits manual reciprocation of the bolt and when the shell is disengaged from the bolt the first end of the bolt is retained within the body and inaccessible for manual manipulation, wherein: the shell releasably engages the bolt in a plug and socket connection, the plug being defined by the handle and the socket being defined by the bolt; the socket has one or more recesses disposed on its periphery; the plug has a tab for each of said one or more recesses; and each tab releasably engages the recess for which it is provided to provide for releasable engagement of the handle and the bolt, wherein each tab is adapted to flex inwardly towards the axis for the release of the handle from the bolt;

the plunger, upon actuation, moves from a restraining position, wherein the plunger is disposed inwardly from and abutting each tab to restrain same against inward flexure, to a release position, wherein each tab is free for said inward movement; and wherein the bolt and the plunger are a pair of separate components.

12. A lock according to claim 11, wherein in the restraining position, an end of the plunger is disposed inwardly from each tab, to restrain said each tab against the inward flexure; and in the release position, a reduced girth portion of the plunger, set back from the end, is disposed inwardly from each tab, so that each tab is free for the inward movement.

13. A lock according to claim 1, wherein the body comprises a base portion and a cover portion, the base portion and the cover portion having longitudinally extending recesses and pairs of inter-engaging longitudinally-extending keyways, respectively on opposite sides, to enable the cover portion to be slidably attached to and detached from the base portion; and when the base portion is operatively mounted on an element to be secured by the lock to another element, and the element to be secured and the other element are positioned for said securement, the cover portion is not slidably detachable from the base portion as a result of interference with the other element.

14. A lock according to claim 13, wherein one of the keyways in the cover portion has enlarged end portions which each receive a peg at the corresponding end of the keyway in the base portion so that the cover portion, if mounted with the pegs disposed on the end of the body through which the end portion of the bolt protrudes, is more readily removed by sliding the cover portion in the direction in which bolt protrudes.

* * * * *